US007028345B2

(12) United States Patent
Waldman

(10) Patent No.: US 7,028,345 B2
(45) Date of Patent: Apr. 18, 2006

(54) GARMENT WITH NECK AND HEAD COVERING

(76) Inventor: Ellen Waldman, 30 Stephens Mill Rd., Hackettstown, NJ (US) 07840

( * ) Notice: Subject to any disclaimer, the term of this patent is extended or adjusted under 35 U.S.C. 154(b) by 0 days.

(21) Appl. No.: 10/973,773

(22) Filed: Oct. 26, 2004

(65) Prior Publication Data

US 2005/0060789 A1 Mar. 24, 2005

Related U.S. Application Data

(63) Continuation-in-part of application No. 10/612,137, filed on Jul. 2, 2003, now abandoned.

(51) Int. Cl.
*A41D 23/00* (2006.01)

(52) U.S. Cl. ..... 2/468

(58) Field of Classification Search ..... 2/69, 2/85, 93–94, 115, 108, 69.5, 129, 101, 208, 2/2.14, 468, 123, 91, 242, 23, 2.15, 102, 2/2.17, 2.11

See application file for complete search history.

(56) References Cited

U.S. PATENT DOCUMENTS 746,586 A * 12/1903 Schoch et al. ..... 2/91
4,495,660 A * 1/1985 Hayden ..... 2/91
4,833,732 A * 5/1989 Harmsen ..... 2/102
4,862,517 A * 9/1989 Meistrell ..... 2/2.17
5,153,938 A * 10/1992 Epperson ..... 2/2.14
5,806,090 A * 9/1998 Johnson ..... 2/2.15
6,185,752 B1 * 2/2001 Hendersen et al. ..... 2/242
6,397,403 B1 * 6/2002 Waldman ..... 2/468

* cited by examiner

*Primary Examiner*—Tejash Patel
(74) *Attorney, Agent, or Firm*—Benjamin Applebaum

(57) ABSTRACT

A garment comprises a neck member including a body having two ends, a zipper attached to the body near the ends, and may include a head covering (or hood) member. Other embodiments include vest, jacket or pullover configurations. The zipper, installed in the conventional (up-and-down) manner, may extend the length of the garment; where it approaches the garment's neck portion, the zipper's direction changes to an angle that is about 45 degrees, such that when the zipper is moved into a closed position, the garment enables the wearer to warm their neck, and when the wearer wants to cool down, the zipper is moved into an open position, such that the ends of the neck member are separated and remain open, exposing an area of the wearer and enabling the exposed area to be cooled down without interference from the garment.

18 Claims, 6 Drawing Sheets

GARMENT WITH NECK AND HEAD COVERING

CROSS REFERENCES TO RELATED APPLICATIONS

This application is a continuation-in-part of U.S. patent application Ser. No. 10/612,137 now abandoned, filed 2 Jul. 2003, the contents of which are hereby incorporated by reference herein in their entirety.

FIELD OF THE INVENTION

Embodiments of the present invention include articles of apparel which can warm the wearer's neck, or neck and head, and includes a means to open the neck portion readily so the wearer can maintain a comfortable temperature while participating in various activities, such as, but not limited to skiing, ice skating, snowmobiling and the like.

BACKGROUND OF THE INVENTION

In the northern hemisphere, keeping warm in winter is often a problem. When engaging in outdoor activities such as skiing, sledding, iceskating, snowmobiling, snowboarding, snowshoeing, running, and the like, this situation can be exacerbated; exposed body parts become even colder because of their exposure to the wind created by the speed of the participant moving through the cold environment. To protect against exposure, and keep the neck, face and head warm, people wear various items such as ski masks, scarves, mufflers, hats or hoods to cover these regions. While these garments initially help to warm up or protect the exposed areas from the cold, because of the heat generated by the individual while engaging in these activities, that additional heat can, over time, lead to overheating. Because many of these activities require the participant to maintain their balance, or to maintain their concentration, it becomes difficult to adjust or remove these items without risking a potential accident.

Hayden (U.S. Pat. No. 4,495,660) discloses a neck garment comprising a muffler portion and an integral apron portion. The garment includes a set of interengageable fastening means that extend across the width of each end of the material, such that the garment can be put on and around the wearer's neck without having to be extended over the wearer's head. The closure can be either a zipper, hook and loop fasteners, buttons or snaps.

In U.S. Pat. No. 4,168,543 Baker discloses a protective neck garment, a one-piece, continuous, resiliently stretchable structure that is generally tubular in shape and adapted to fit over and conform closely to the wearer's neck. An embodiment includes an inner layer intended to protect the wearer's neck from irritation by the garment's outer layer. The inner layer extends beyond the outer layer, and can be rolled over the outer layer. The outer layer may be made from an insulating material, such as stretch wool, and the inner layer of cotton to protect the wearer's neck from irritation.

Coursey (U.S. Pat. No. 2,507,333) discloses a closure for mufflers, wherein the zipper is inserted into the garment such that the zipper is hidden when the garment is closed.

U.S. Pat. No. 2,042,442 (Buchman) discloses a scarf which is closed by a zipper (which is exposed) when worn on the individual's neck. Buchman discloses using down, sewn in pockets within the scarf, for added warmth.

In U.S. Pat. No. 811,096 Scott discloses a muffler which is closed by means of snap fasteners, positioned in the back of the muffler when worn.

Herbranson (U.S. Pat. No. 2,346,918) discloses a one piece neck scarf comprising a rectangular piece of fabric and a zipper attached along a side of the fabric, and the zipper can be used to completely or partially fasten the scarf when worn around the wearer's neck.

In U.S. Pat. No. 746,586 Schoch et al. disclose a combination muffler and chest protector, one embodiment for males and another for females. The female embodiment uses fasteners, such as buttons or snaps, to close the muffler at the back, when worn by the user.

Campbell (U.S. Pat. No. 4,601,066) discloses a combination fashion and exercise garment including warmers that are attached to the garment and which wrap around the desired body part. The garment includes warmers, strips of material attached at one end to the garment, and which further comprises mating strips to secure the warmer around the body part. The warmers may be permanently attached to the garment by stitching or similar means, or removably attached thereto by means of snaps.

Mustata (U.S. Pat. No. 5,802,618) discloses a neck and chest scarf comprising several layers of material which, when worn, are closed by means of a hook and loop fastener at the back of the user's head and neck. The inventor states that a zipper can be substituted for the hook and loop closures, but using such types of closure at the rear of a garment worn by participants in an active outdoor activity is impractical, particularly in activities where an individual may have other equipment in their hands, or where the individual must maintain their balance.

In U.S. Pat. No. 6,163,883 Hong discloses a garment with a magnetic vent closure, as an example of a garment which can be used for flow-through cooling of the user, such as a motorcyclist, during warm weather and which can be used in conjunction with other protective clothing.

Carey, in U.S. Pat. No. 6,272,690 B1, discloses a head covering comprising a mask member with a head member joined together to define an opening that registers with the eyes. The mask member is formed of neoprene. The head member, formed of a fleece material, has a scarf portion extending below the head to surround the neck area of the user. This one-piece garment provides no means to open or adjust the scarf portion of the head covering.

In U.S. Pat. No. 5,214,804 Carey et al. disclose a protective mask with scarf, held in place about the user's head and neck by a hook and loop fastener, positioned at the rear of the garment, and thus, difficult for one to access while actively engaging in sports.

A recurrent problem described in my previous U.S. Pat. No. (6,397,403 B1), is that once conventional neck warmers or masks are opened, the material still remains on the body part sought to be cooled. Because many of the aforementioned activities require the participant to maintain their balance, or to maintain their concentration, it becomes difficult to adjust or remove these items without risking a potential accident. Furthermore, many individuals engaged in activities such as skiing now wear helmets to protect against the risk of head injury, as well as goggles for eye protection. Helmets and goggles add to the bulk around the individual's neck, and are usually not removed during these activities. A scarf or muffler, once opened, still physically remains in the area, and it may literally be "flapping around in the wind", which can, for example only, cause further distraction, block the wearer's vision or have other consequences, some of which might result in injury. Even using a jacket having a zipper which extends over the wearer's neck and face, once the zipper is opened there still is material that needs to be removed from the area to cool it down. A ski mask or hood also poses similar problems, because if it is pulled down from the head, it still surrounds the neck unless it is completely removed. A hat requires removal, and a convenient place in which to place it safely; and such actions are not always feasible. This inventor has observed this problem with garments including zippers used in the conventional manner (i.e., straight up and down, along the length of the wearer's neck), and has overcome this problem by altering the angle at which the zipper is positioned within the garment, thereby enabling the opened garment to lay out of the way, and allow for cooling of the warmed area.

Embodiments of the present invention are improvements upon my previous invention. In one embodiment, in addition to the garment being used as a neck muffler, it includes a hooded portion which will cover the wearer's head, yet allow the hood portion to be removed from the head, and still allow the wearer to cool their head and neck by means of the zipper contained in the neck member of the garment of the present invention. Other embodiments include a variety of garments such as jackets, vests, pullover garments and/or anoraks having a collar with the configuration of the neck garment and either with or without the hood portion.

One embodiment of the present invention is an article of clothing designed for keeping the wearer's neck warm during outdoor activities, such as skiing or other cold weather activities. This embodiment includes a neck member and a head covering (or hood) member. The hood member can be made from one or more pieces of fabric, and is attached to the neck member. The hood member can be worn over as much of the head as the user desires. The neck member is made of a single piece of fabric, and includes a zipper which is sewn in at an approximately 45 degree angle in relation to the length of the wearer's neck. The neck member is made such that there is a layer of material beneath the zipper, to protect the wearer's neck from contact with the zipper. By using a zipper at this particular angle, the inventor has found the garment can be opened readily by a user while skiing, and can also be kept open, offering the wearer the ability to cool off readily, yet be out of the way, a problem that occurs when a zipper is used in the conventional manner.

BRIEF SUMMARY OF THE INVENTION

It is an object of the present invention is to provide a garment that will provide warmth to its wearer, and be sufficiently easy to open to enable the wearer to cool down.

Another object of the present invention is to provide a garment that when opened, the opened portion will lay out of the way of the wearer.

Another object of the present invention is to provide a garment that can provide warmth to the neck of an individual, and when opened, the opened portion will lay out of the way of the wearer.

Another object of the present invention is to provide a garment that can provide warmth to the head of an individual, and when the hood member of the garment is removed from the wearer's head, and the garment opened, the opened portion will lay out of the way of the wearer.

Still another object of the present invention is to provide a garment that can provide warmth to the head and neck of an individual, and when the hood member of the garment is removed from the wearer's head, and the garment opened, the opened portion will lay out of the way of the wearer.

Another object of the present invention to provide a garment that is easy to use by an individual participating in activities during cold weather.

Another object of the present invention is to provide a garment that is economical to manufacture, and is durable to withstand repeated use.

An embodiment of the present invention is an article of clothing designed for keeping the wearer's neck warm during outdoor activities, such as skiing or other cold weather activities. The garment comprises a body having two ends, a zipper attached to the body near the ends, thereby forming two flaps which are positioned beneath the zipper. The zipper is not as long as the ends, and the remainder of the ends are stitched together. The zipper is attached to the body at an angle that is about 45 degrees, such that when the zipper is moved into a closed position, the garment enables the wearer to warm their neck, and when the wearer wants to cool down, the zipper is moved into an open position, the ends are separated and remain open, exposing an area of the wearer and enabling the exposed area to be cooled down without interference from the garment. The garment is particularly suited for outdoor activities such as skiing.

DETAILED DESCRIPTION OF THE INVENTION

One embodiment of the present invention is an article of clothing 10 designed for wearing about the user's head and neck during what are generally considered to be cold weather activities, such as skiing, iceskating, snowmobiling, snowboarding, snowshoeing, sledding or the like. While the present invention is intended for use in outdoor activities, it is to be understood that the present invention could be worn indoors, such as in ice arenas or the like. No limitation to outdoor wear is intended, or for its use at specific temperatures or climates, except as described within the appended claims, because using different materials for manufacturing could facilitate use of these garments over various temperature ranges.

Figure 5:
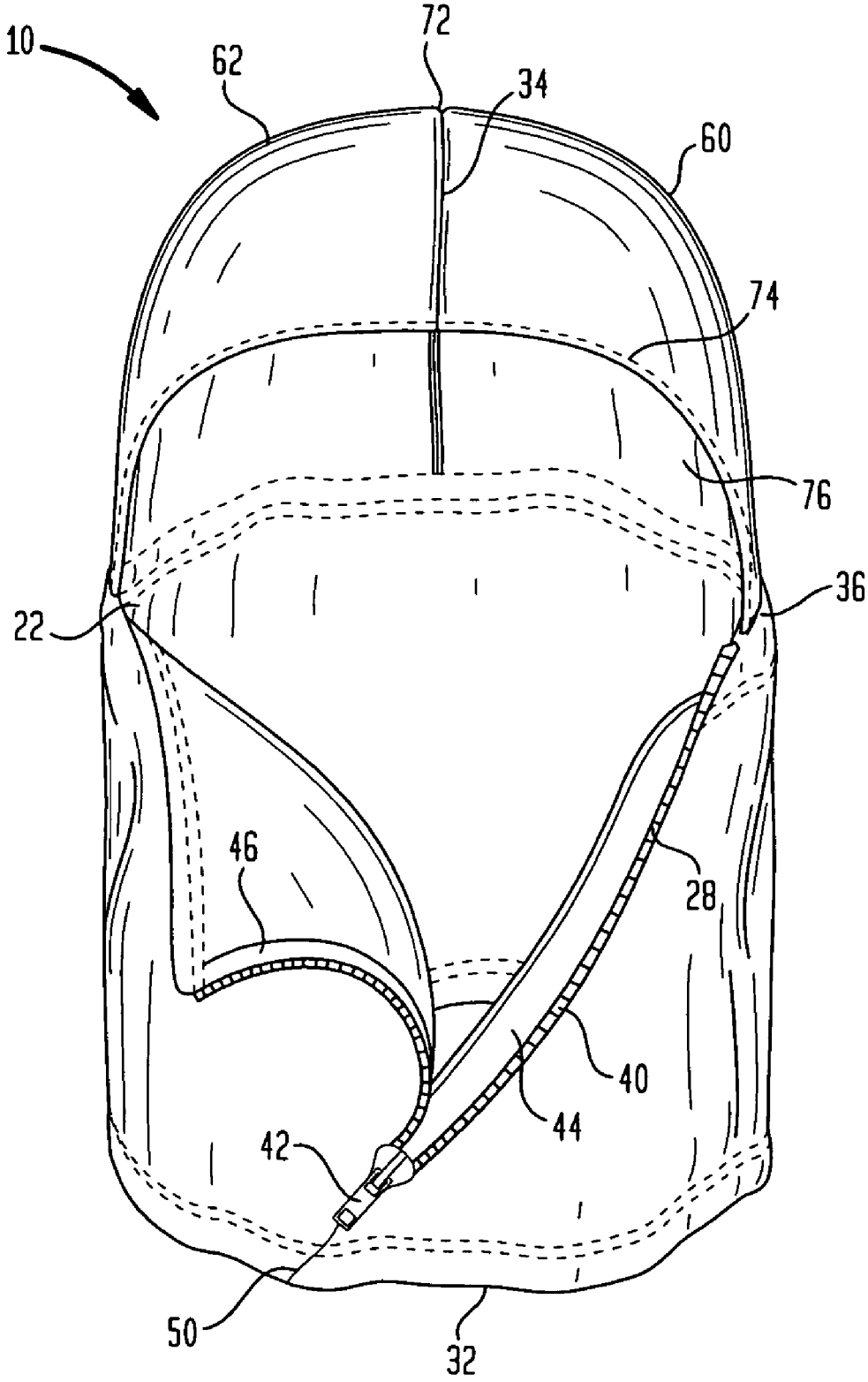
FIG. 5 illustrates an embodiment of the present invention in an open position.

An embodiment of the present invention 10 (FIG. 1) is a head and neck garment. This embodiment of the head and neck garment 10 is made from several pieces of fabric. The garment 10 comprises a neck member 20 and a head member, or hood, 60. Neck member 20 is made from a single piece of fabric, with each piece having a first (inner) surface 22 and a second (outer) surface 24 and two ends 26 and 28, from a pattern (not shown) that essentially has the form of a parallelogram, or an alternate embodiment of the neck member could be made from one or more pieces. When the neck member is assembled, the first surface 22 becomes the inner surface 22 of the garment's neck member 20, and the second surface 24 becomes the outer surface 24 (FIG. 5).

Prior to assembly, and to create a more finished appearance, a portion 30 and 32 of the outer surface 14, are folded over onto a portion of inner surface 22 and joined together by means of stitching 34 to form upper seam 36 and lower seam 38. It is to be understood that other means of attaching fabrics to one another to form seams can be employed, and such methods can include attachment by means of heat, hot melt glues, adhesives, or other methods known to those skilled in the art.

Figure 1:
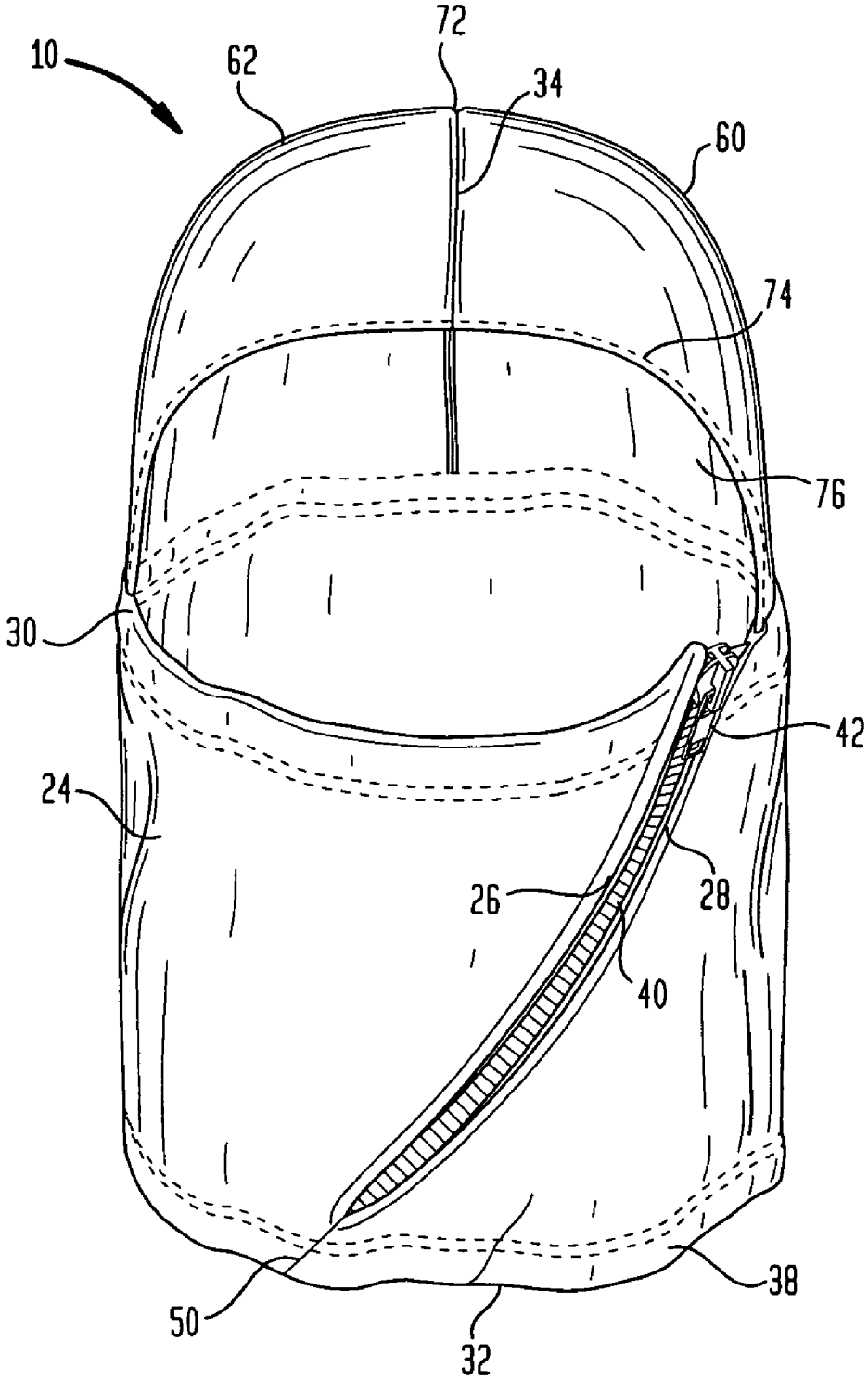
FIG. 1 is a plan view of one embodiment of the present invention, with the closure in the closed position.
Figure 3:
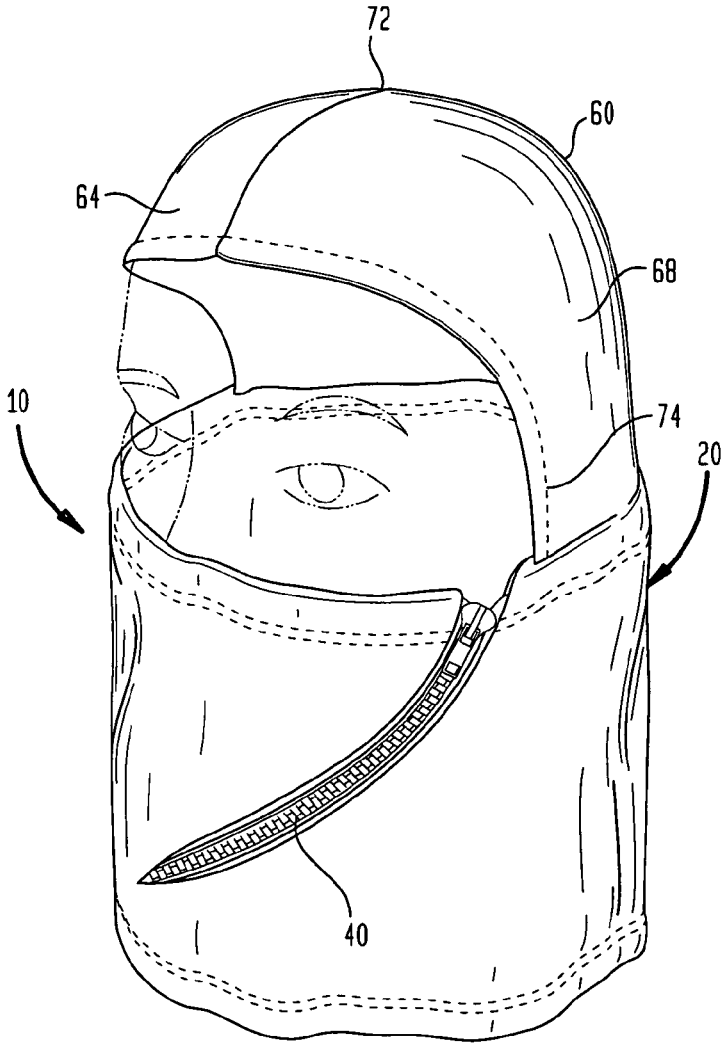
FIG. 3 is a view of the embodiment of FIG. 1 when worn over the head and covering part of the face.

Referring to FIGS. 1 and 3, the ends 26 and 28 of neck member 20 are joined by a closure 40. In this embodiment, closure 40 is a zipper, and the zipper terminates with a traditional zipper pull-tab 42. Other means for operating the zipper can be substituted for or added to, pull-tab 42, such as rings (metallic, or non-metallic, such as, but not limited to plastics, nylon, and the like), tabs made from materials other than metals, such as plastics or rubber, or fabrics such as leather or leather-like synthetic materials, nylon, natural and synthetic yarns, rope, or other durable material.

Figure 2:
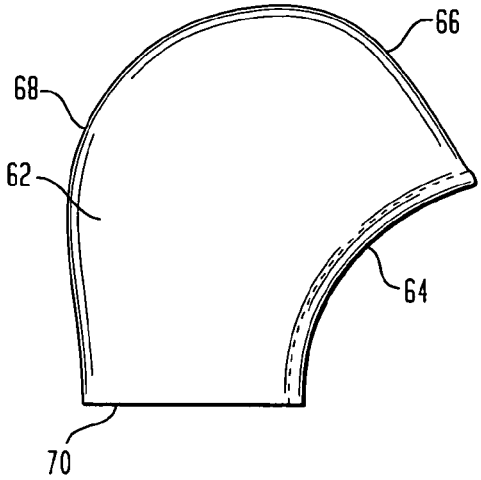
FIG. 2 is a plan view of a fabric piece used to manufacture the hood member.
Figure 4:
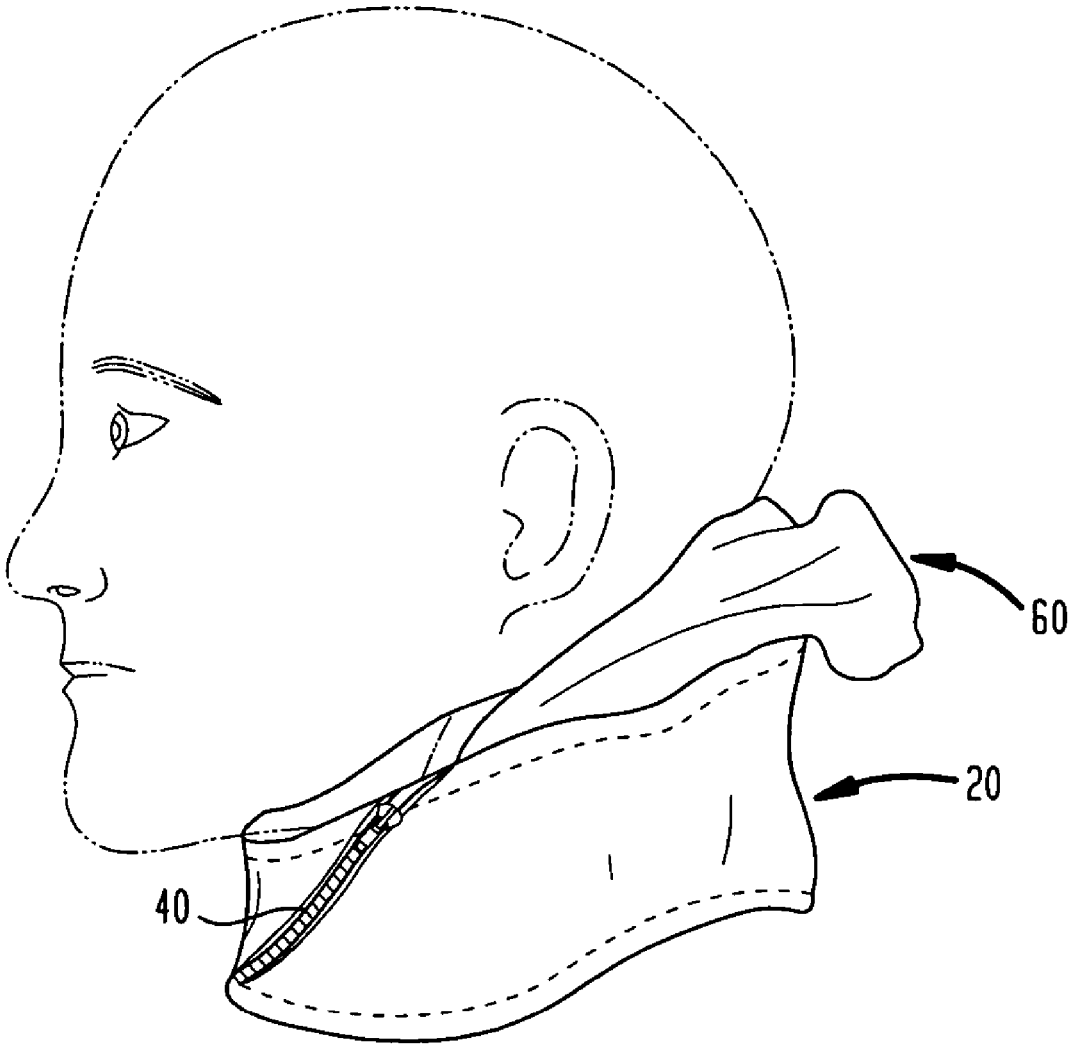
FIG. 4 shows the hood member worn behind the head.

The hood member 60 (or head covering member) is made from two pieces of fabric 62, shaped generally as shown in FIG. 2. Each piece of fabric includes a front surface 64, a top surface 66, a rear surface 68 which is contiguous with the top surface 66, and a bottom surface 70. The hood member 60 is formed by joining the fabric pieces along their top 66 and rear 68 surfaces, forming an elongated body, having a seam 72 created by stitching 34. As shown in the drawings, the seam and stitching is inside the hood, but the seam and stitching can be positioned in any manner that one of ordinary skill in the art may deem appropriate. A second seam 74 is formed along the front edges by means of stitching 34, to provide the garment with a more finished appearance. The hood member 60 (head covering member) is joined to the neck member 20 by stitching the hood member (head covering member) proximate its bottom surface 70 to the upper seam 36 of neck member 20, such that the closure 40 remains in the front of the head and neck garment 10. As shown in FIG. 1, this results in the formation of an opening 76 for insertion of the wearer's head and face through the garment. The garment 10 is made from a stretchable fabric (described below) and fits over the head and neck of the wearer. The hood member 60 (or head covering member) can be worn so that is covers the head (FIG. 3) or rests behind the head or neck (FIG. 4), or anywhere in between, depending upon the needs of the wearer. The wearer's eyes are visible through the opening 76, and the front of the neck member 20 can be positioned as low or as high on the face as the wearer desires, such that much of the face and nose can be protected, while still allowing vision.

Although assembly of the hood member 60 (head covering member) using multiple pieces of fabric has been described herein, it is to be understood that a hood member produced using other methods, such as from a single piece of fabric, or from more than two pieces of fabric, or from a knitted or crocheted material is expressly contemplated to be within the scope of the present invention.

In the embodiment shown in FIG. 1, the zipper 40 is not coextensive with the length of ends 26 and 28. In this manner, embodiments of the present invention are intended to be opened and worn by first pulling it over the head and neck of the wearer. Further, because the zipper 40 is not coextensive with the length of the ends, the garment 10 should not come off during use.

Typically, zippers are inserted in garments such that when the garment is worn, the zipper is parallel to the longitudinal axis of the garment (i.e., generally straight up and down, as in a jacket or pair of trousers). In these embodiments, the zipper 40 around the neck or collar is sewn into the garment at an angle of approximately 45 degrees in relation to the length of the wearer's neck. By insertion of the zipper 40 at the angle shown in FIG. 1 the inventor has found that during an activity such as downhill skiing, the user can readily open the garment 10 by sliding zipper 40 to a desired position, and that the ends 26 and 28 joined by the zipper can be easily separated.

The ends 26 and 28 are joined (FIG. 5) such that there is overlap between the ends and the zipper 40, forming a first flap 44, which flap protects the wearer's neck from contact with the zipper. Second flap 46, attached to end 26, is generally smaller than first flap 44. First flap 44 has a length that is greater than the length of the zipper 40, and first flap 44 may be coextensive with the length of ends 26 and 28. The garment 10 is closed by taking the remaining portions of each ends 26 and 28 that are not connected by zipper 40 and attaching them to one another by conventional methods of attachment, such as stitching 34, forming seam 50.

As shown in FIGS. 1 and 3, the zipper 40 is sewn into the garment at an approximately 45 degree angle in relation to the length of the wearer's neck. By insertion of the zipper 40 at this particular angle, it has been found that the garment can be opened readily by a user while skiing, and that the garment can be kept open. The combination of easy opening and the ability to remain open is an advantage of the present invention. These embodiments offer the wearer the ability to cool off readily, yet not have material covering up the area to be cooled down, or getting in the way, a problem that occurs when a zipper is used in the conventional manner (i.e., straight up and down, along the length of the wearer's neck).

These garments are made such that there is a layer of material beneath the zipper, to protect the wearer's neck from contact with the zipper.

Another embodiment (FIG. 6) is a vest 100 with a collar. Vest 100 (FIG. 1) comprises a pair of front members 102 joined to a back member 104 to form the torso component of the garment, and a collar. A pair of armholes 108 are formed in the torso component. For purposes of the present specification, collar will also be referred to as neck member 120, and collar may comprise a head member, or hood (260, see FIG. 7) attached thereto. In this embodiment, the collar and hood would be worn similarly to the embodiments shown in FIGS. 1–5. Neck member 120 could be made from a single piece of fabric, and attached to the front and back members 104 and 106, respectively by stitching its lower region to the upper portion of the front and back members. Attachment could be by means of stitching 134 or other means of attachment. In an alternative embodiment (not shown) neck member 120 could be formed as an integral part of the front and back members.

When neck member 120 is a single piece of fabric, it comprises a first (inner) surface 122 and a second (outer) surface 124 and two ends 126 and 128, similar to the embodiment shown in FIG. 1. As described previously, when neck member 120 is assembled, first surface 122 becomes the inner surface 122 of the collar 120, and the second surface 124 becomes outer surface 124 (FIG. 6).

Figure 6:
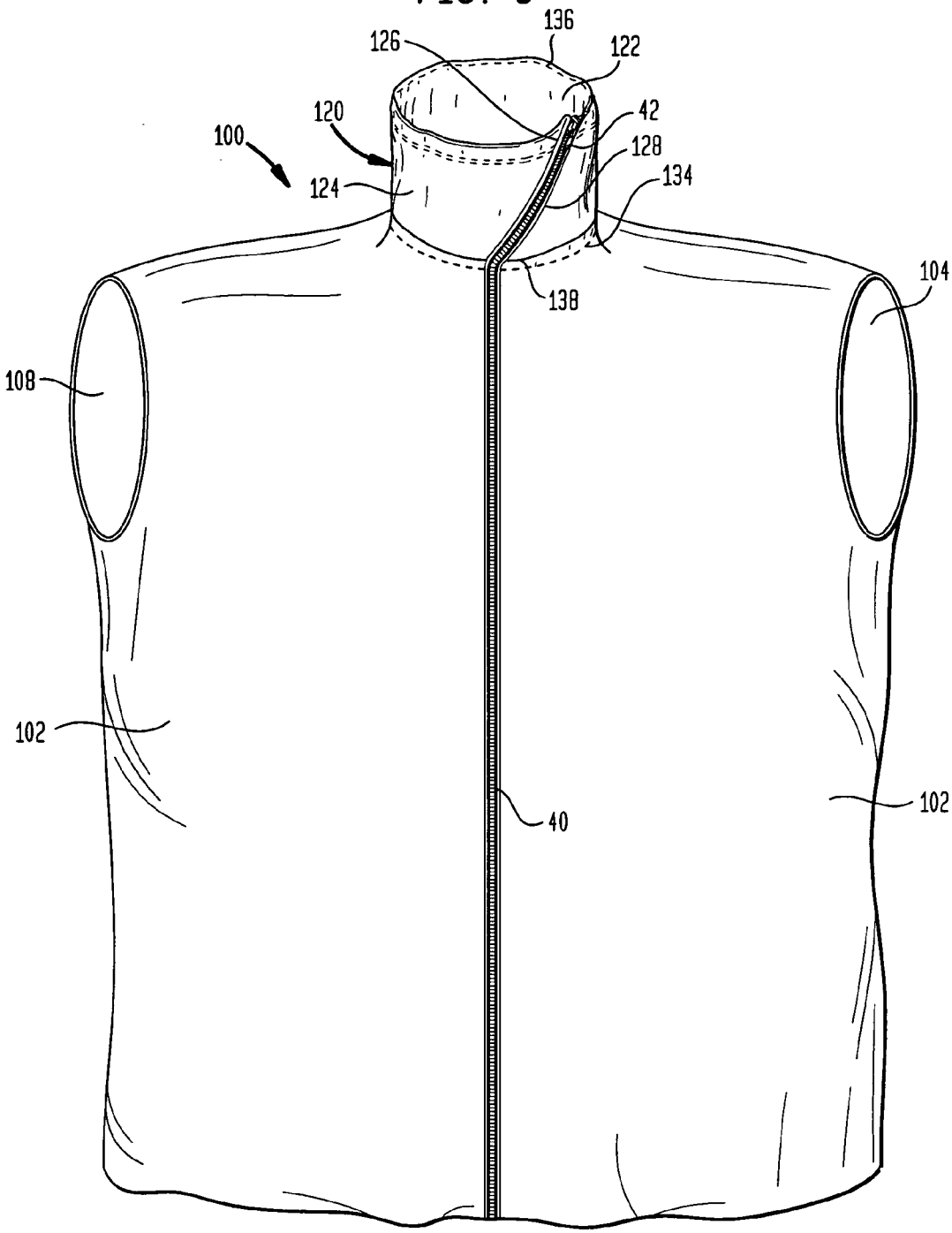
FIG. 6 is a plan view of a second embodiment of the present invention, with the closure in the closed position.

Although not shown in FIG. 6, attachment of sleeves to vest 100 proximate the armholes 108 results in the garment taking on the configuration of a jacket. The sleeves could be attached to the vest either in a permanent manner, such as by standard sewing techniques, or be attached so the sleeves are removable, such as by means of a zipper, hook and loop fasteners, or other means of attachment known to those skilled in the relevant art. The length of the front and back members 102 and 104, respectively, can be increased or decreased to form different types of jackets or vests of various lengths.

Other components described in reference to FIGS. 1–5, such as the flap underneath the zipper, linings, and stitching are elements of this embodiment, but are not shown in FIG. 6 for purposes of clarity.

Upper seam 136 and lower seam 138 are formed in the same manner as the upper and lower seams of the embodiment of FIG. 1. It is to be understood that other means of attaching fabrics to one another to form seams can be employed, and such methods can include attachment by means of heat, hot melt glues, adhesives, or other methods known to those skilled in the art.

Referring to FIG. 6, the ends 126 and 128 of neck member 120 are joined by a fastener or closure 40. Fastener 40 is a zipper, and the zipper terminates with a traditional zipper pull-tab 42, such has been described for the first embodiment of this invention. Other means for operating the zipper can be substituted for or added to, pull-tab 42, as has been previously described for the first embodiment.

The zipper 40 is coextensive with the length of the garment 100. However, for much of the length of the front members 102 the zipper is positioned in the conventional manner (that is, up and down the length of the garment 100). In the region where the collar 120 is attached, zipper 40 becomes angled in the same manner as described for the embodiment shown in FIG. 1. This garment embodiment is worn in the same manner as a zippered vest, the difference being the angle of the zipper along the wearer's neck, and that the neck will stay open once the zipper has been pulled down from the closed position.

Another embodiment 200 (FIG. 7) of the present invention employs a zipper 240 that is not coextensive with the length of the garment front. Zipper 240 extends for a portion of the garment front, such that this embodiment has the configuration of a garment commonly referred to as an anorak. Zipper 240 is controlled by a conventional zipper pull 242.

This embodiment 200 comprises a front member 202, back member 204, neck member 220 and head member, or hood, 260. Neck member 220 is made from a single piece of fabric, with each piece having a first (inner) surface 222 and a second (outer) surface 224 and two ends 226 and 228, similar to the description of the first embodiment. When the neck member is assembled, the first surface 222 becomes the inner surface 222 of the garment's neck member 220, and the second surface 224 becomes the outer surface 224. This embodiment 200 includes sleeves 250.

The hood member 260 (or head covering member) is made as has been described for the embodiment shown in FIG. 2. Each piece of fabric 62 includes a front surface 64, a top surface 66, a rear surface 68 which is contiguous with the top surface 66, and a bottom surface 70. The hood member 260 is formed by joining the fabric pieces along their top 66 and rear 68 surfaces, forming an elongated body, having a seam 72 created by stitching 34. As shown in the drawings, the seam and stitching is inside the hood, but the seam and stitching can be positioned in any manner that one of ordinary skill in the art may deem appropriate. A second seam 74 is formed along the front edges by means of stitching 34, to provide the garment with a more finished appearance. The hood member 260 (head covering member) is joined to the neck member 220 by stitching the hood member (head covering member) proximate its bottom surface 70 to the upper seam 236 of neck member 220, such that the closure 40 remains in the front of the garment 200, resulting in the formation of an opening 76 for insertion of the wearer's head and face through the garment. The wearer's eyes are visible through opening 76, and the front of the neck member 220 can be positioned as low or as high on the face as the wearer desires, such that much of the face and nose can be protected, while still allowing vision.

Although assembly of the hood member 260 (head covering member) using multiple pieces of fabric has been described herein, it is to be understood that a hood member produced using other methods, such as from a single piece of fabric, or from more than two pieces of fabric, or from a knitted or crocheted material is expressly contemplated to be within the scope of the present invention.

Figure 7:
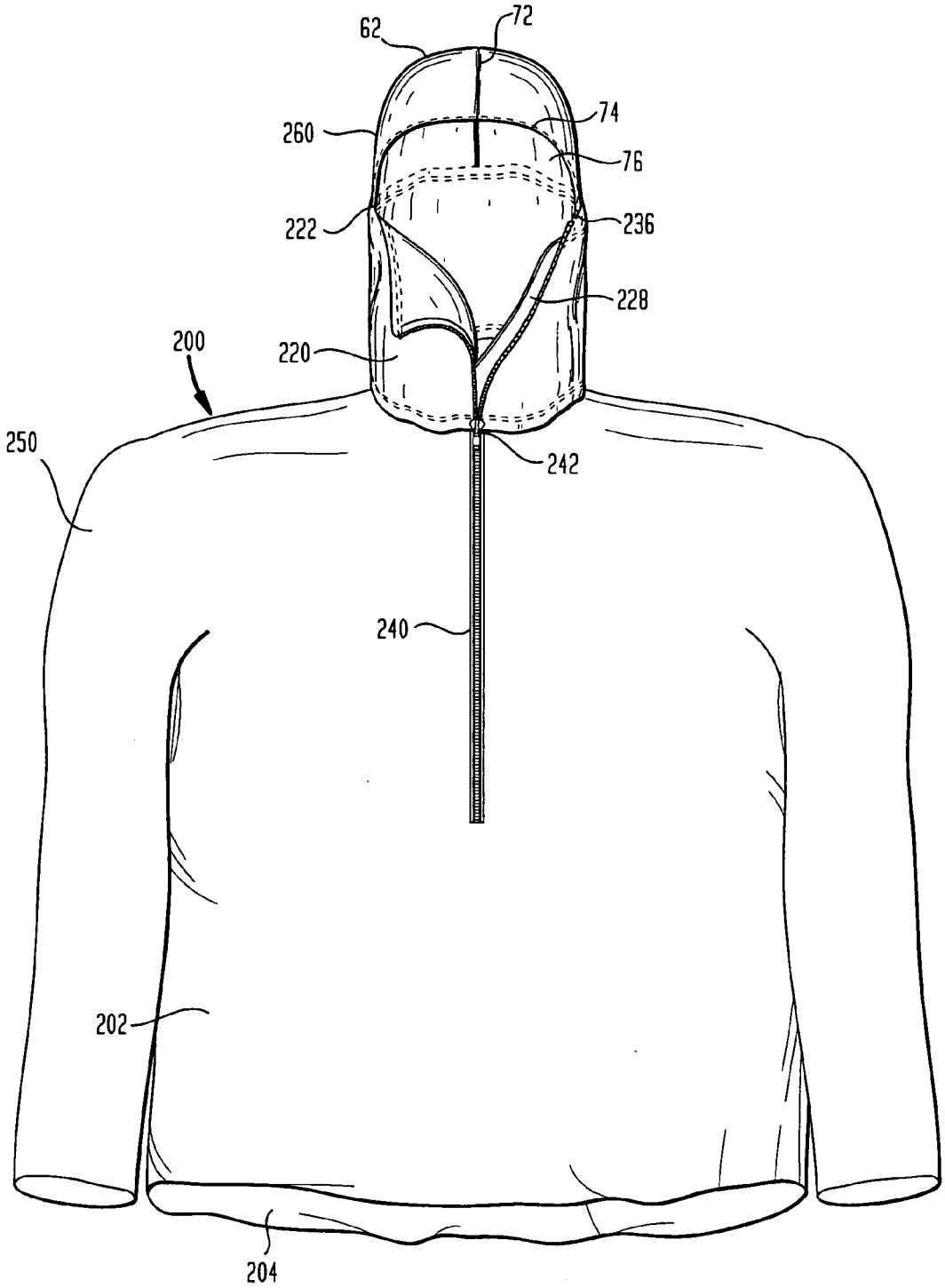
FIG. 7 is a plan view of a third, pullover or anorak-type garment, embodiment of the present invention, with the closure in an open position.

Garment embodiments 100 or 200, such as shown in FIGS. 6–7, could also be configured to include one or more pockets, both on the outside or on the inside, and one or more pockets could be included on the back of the garment. These pockets could have various configurations, such as small and shallow, or deep and wide, with or without a clear outer layer, such that other embodiments of these garments could be used by sportsmen for fishing, hunting, or other outdoor sports, utility vests, or numerous other functions.

As has been described for the second embodiment 100, this pullover embodiment 200 could also be manufactured in variations having removable sleeves, without sleeves, or without the hood member. Various combinations are also possible, and are contemplated to be within the scope of the present invention. These garments are made such that there is a layer of material beneath the zipper, to protect the wearer's neck from contact with the zipper.

In one embodiment, the present invention is manufactured from a material sold under the trademark POLARFLEECE® (Registered trademark of Malden Mills Industries, Inc., Lawrence Mass.), which is a stretch type material now commonly used for the manufacture of outdoor garments, but can be made from any suitable material, including POLARTEC® (Registered trademark of Malden Mills Industries, Inc., Lawrence Mass.), POLARTEK® (Registered trademark of Ads Properties Corp., Burlington Vt.), or similar materials.

Although not shown in the drawings, a lining can be included in the garment for added warmth, and the lining can be any suitable material. The lining can be sewn into the garment using conventional methods, and depending upon the style selected by a manufacturer, could extend beyond the body of the neck garment 10 of the present invention.

In use, the user opens up a hooded garment embodiment 10 by unzipping the zipper, and the user pulls the open garment over their head until it rests over their neck, and the hood member 60 covers as much of their head as the user deems necessary. The zipper is then moved to a position that the user finds comfortable. The wearer can place the hood member 60 over their head, either partially or completely, or position it so that is remains behind their neck. The garment 10 can be worn under the user's outer clothing, such as over a shirt; over outerwear such as a jacket, jumpsuit or the like; or in any manner the user finds comfortable. Generally the garment is worn with its zippered region in the front, but if the hood member is not worn over the head, any position that is comfortable to the wearer and which enables the wearer to grasp the zipper can be employed. As the user is participating in a particular activity, as they feel warm, the hood member 60 can be pushed back, and/or the zipper can be grasped and opened, the ends 26 and 28 are separated, enabling the user to cool themselves down or to reach a comfortable temperature. The open garment remains on the wearer. As the wearer cools off sufficiently, and seeks additional warmth, the garment is then closed by moving the zipper to a comfortable closed position, and, where desired, the hood member is repositioned as desired on the wearer's head. The other embodiments are worn in the same way as either a vest, jacket, or anorak, and the zipper positioned where the user feels comfortable, as previously described for the first embodiment.

Therefore, although this invention has been described with a certain degree of particularity, it is to be understood that the present disclosure has been made only by way of illustration and that numerous changes in the details of construction and arrangement of parts may be resorted to without departing from the spirit and scope of the invention.

I claim:

1. A garment comprising:

a head covering member, comprising:

an elongated body having a front end; and a back end having a bottom surface;

a neck member having a body, comprising:

two ends, the ends being joined by a means for fastening, the means for fastening not being coextensive with the ends;

the means for fastening attached to the body proximate one of the ends, forming a flap, the flap positioned beneath the means for fastening;

the body further having an upper region;

the head covering member being joined to the neck member upper region by attachment of the head covering member proximate its bottom surface;

the means for fastening being attached to the neck member at an angle that is not parallel with the length of the neck of a wearer; and a means for connecting, the means for connecting joining the neck member ends at a region where the neck member ends are not connected by the means for fastening, such that when the means for fastening is moved to an open position, the garment remains open when worn by the wearer.

2. The garment as described in claim 1, wherein the means for fastening is a zipper.

3. The garment as described in claim 2, wherein the zipper is attached to the neck member body at an angle between about 10 degrees and about 170 degrees.

4. The garment as described in claim 3, wherein the zipper is attached to the neck member body at an angle between about 30 degrees and about 150 degrees.

5. The garment as described in claim 4, wherein the zipper is attached to the neck member body at an angle of about 45 degrees.

6. The garment as described in claim 1, wherein the means for fastening is further attached to the neck member body proximate the second end, forming a second flap, the second flap being beneath the means for fastening.

7. The garment as described in claim 6, wherein the head covering member further comprises a second seam, the second seam being formed along the front edge.

8. The garment as described in claim 2, wherein the bottom surface of the head covering member is not coextensive with the neck member body.

9. A garment comprising:

a head covering member, comprising:

an elongated body having a front end; and a back end having a lower edge;

a neck member having a body, the body comprising two ends, a zipper attached to the body proximate the ends, forming a first flap and a second flap, both flaps being positioned beneath the zipper, the zipper not being coextensive with the ends, the zipper being attached to the body proximate one of the ends, the body further comprising an upper region;

the head covering member being joined to the neck member upper region by attachment of the head covering member proximate its lower edge, a means for connecting, the means for connecting closing the body at a region where the ends are not connected to the zipper; and the zipper being attached at an angle that is about 45 degrees;

such that when the zipper is moved into a closed position, the garment enables the wearer to warm their neck, and when the zipper is moved into an open position, the garment enables the wearer to cool their neck, and the ends are separated and remain open, exposing an area of the wearer and enabling the exposed area to be cooled down without interference from the garment.

10. A garment comprising:

a head covering member, comprising:

an elongated body having a front end; and a back end having a lower edge;

a neck member having a body, comprising:

two ends, the ends formed at an angle that is not perpendicular to the body, the ends being joined by a means for fastening, the means for fastening not being coextensive with the ends;

the means for fastening attached to the body proximate one of the ends, forming a flap, the flap positioned beneath the means for fastening;

the body further having an upper region;

the head covering member being joined to the neck member upper region by attachment of the head covering member proximate its lower edge; and a means for connecting, the means for connecting joining the neck member ends at a region where the neck member ends are not connected by the means for fastening, such that when the means for fastening is moved to an open position, the garment remains open.

11. The garment as described in claim 10, wherein the means for fastening is a zipper.

12. The garment as described in claim 11, wherein the zipper is attached to the neck member body at an angle between about 10 degrees and about 170 degrees.

13. The garment as described in claim 12, wherein the zipper is attached to the neck member body at an angle between about 30 degrees and about 150 degrees.

14. The garment as described in claim 13, wherein the zipper is attached to the neck member body at an angle of about 45 degrees.

15. The garment as described in claim 10, wherein the means for fastening is further attached to the neck member body proximate the second end, forming a second flap, the second flap being beneath the means for fastening.

16. The garment as described in claim 15, wherein the head covering member further comprises a second seam, the second seam being formed along the front edge.

17. The garment as described in claim 11, wherein the bottom surface of the head covering member is not coextensive with the neck member body.

18. A garment comprising:

a head covering member, comprising:

an elongated body having a front end; and a back end having a lower edge;

a neck member having a body, the body comprising two ends, the ends formed at an angle that is not perpendicular to the body, a zipper attached to the body proximate the ends, forming a first flap and a second flap, ,both flaps being positioned beneath the zipper, the sipper not being coextensive with the ends, the zipper being attached to the body proximate one of the ends, the body further comprising an upper region;

the head covering member being joined to the neck member upper region by attachment of the head covering member proximate its lower edge;

a means for connecting, the means for connecting closing the body at a region where the ends are not connected to the zipper; and the zipper being attached at an angle that is about 45 degrees;

such that when the zipper is moved to an open position, the ends are separated and the garment remains open.

* * * * *